219-121 SR
3/24/87 XR 4,652,462

United States Patent [19]
Nishizawa et al.

[11] Patent Number: 4,652,462
[45] Date of Patent: Mar. 24, 1987

[54] METHOD OF PRODUCING PHOSPHOR SCREEN OF COLOR PICTURE TUBE

[75] Inventors: Masahiro Nishizawa; Kiyoshi Miura; Osamu Sasaya, all of Mobara; Yoshiyuki Odaka, Isumi, all of Japan

[73] Assignee: Hitachi, Ltd., Tokyo, Japan

[21] Appl. No.: 763,614

[22] Filed: Aug. 8, 1985

[30] Foreign Application Priority Data

Aug. 8, 1984 [JP] Japan ..... 59-164911

[51] Int. Cl.[4] ..... B05D 3/06; B05D 5/06
[52] U.S. Cl. ..... 427/53.1; 219/121 LH; 219/121 LJ; 427/68; 427/226; 427/228; 427/244; 427/270; 427/271; 427/282; 430/24; 430/25; 430/945
[58] Field of Search ..... 427/53.1, 68, 228, 226, 427/282, 270, 271, 264; 430/24, 25, 945; 219/121 LH, 121 LJ

[56] References Cited

U.S. PATENT DOCUMENTS

| | | | |
|---|---|---|---|
| 3,558,310 | 1/1971 | Mayaud | 430/25 |
| 3,574,657 | 4/1971 | Burnett | 427/53.1 |
| 3,637,410 | 1/1972 | Stevens | 427/53.1 |
| 4,117,177 | 9/1978 | Schlater | 427/68 |
| 4,268,186 | 4/1981 | Provancher | 219/121 LH |
| 4,388,517 | 6/1983 | Schulte et al. | 427/53.1 |

*Primary Examiner*—Norman Morgenstern
*Assistant Examiner*—Janyce A. Bell
*Attorney, Agent, or Firm*—Antonelli, Terry & Wands

[57] ABSTRACT

Disclosed herein is a method of producing a phosphor screen of color picture tube wherein a light absorbing material is applied onto the inner surface of a panel, a shadow mask is provided, the surface of film of the light absorbing material is scanned and irradiated with a laser beam via the shadow mask so that portions of the light absorbing material irradiated with the laser beam are heated and burned, thereby to form a black matrix. According to this method, the number of steps for forming the black matrix is decreased, and the quality and yield of the phosphor screen are increased.

11 Claims, 4 Drawing Figures

METHOD OF PRODUCING PHOSPHOR SCREEN OF COLOR PICTURE TUBE

BACKGROUND OF THE INVENTION

The present invention relates to a method of producing a phosphor screen of color picture tube, and more particularly to a method of producing a black (light-absorbing) matrix of a color television picture tube, which permits very few defects to develop on the phosphor screen, which enables the manufacturing process to be simplified, and which contributes to reducing the manufacturing cost.

According to methods of manufacturing a black matrix of a color television picture tube that have heretofore been put into practice as disclosed in Japanese Patent Publication No. 218/1971, or in U.S. Pat. No. 3,558,310, a photosensitive material is applied onto the inner surface of a picture tube panel, exposed through a shadow mask, developed to form a desired pattern, and a suspension of light-absorbing material such as graphite is applied onto the whole surface, followed by a treatment with an etching solution consisting of an aqueous solution of hydrogen peroxide, sodium hypochlorite or the like, so that the photosensitive material that is exposed and cured is swollen and eroded. The photosensitive material is then developed again and is eroded, and is peeled off together with the light-absorbing material to form a black matrix pattern composed of the light-absorbing material that was not exposed. Thereafter, phosphor film patterns of green, blue and red are formed on the inner surface of the panel by such methods as a slurry or a dusting method, a film of acrylic resin is formed on the phosphor film patterns of these colors, a metal backing film is formed by evaporation on the upper surface thereof, and the panel is baked to remove organic compounds from the phosphor film patterns and the film of acrylic resin, thereby forming a phosphor screen of the black matrix type.

According to such a conventional method of producing phosphor screens, however, the black matrix pattern is formed through lengthy steps consisting of panel washing—coating of the photoresist - exposure through shadow mask-developing—coating of light absorbing material-etching. Therefore, when the above method is adapted to form a phosphor screen of a superfine pitch tube that has been developed in recent years, minor defects that develop through the above-mentioned steps build up to deteriorate the quality of the phosphor screens as a whole and to decrease the production yield, making it difficult to meet the demand for the product.

SUMMARY OF THE INVENTION

The object of the present invention is to provide a method of producing a phosphor screen of a color picture tube, which eliminates difficulties inherent in the above-mentioned conventional art, which enables the steps for forming a black matrix to be simplified, and which makes it possible to increase the quality and yield of phosphor screens as a result of a reduced number of manufacturing steps.

According to a method of producing a phosphor screen of a color picture tube according to the present invention, which achieves the above-mentioned object, a light absorbing material is applied, as a film, onto the inner surface of a panel, a shadow mask is fitted thereto, the film surface of the light absorbing material is irradiated with a laser beam through the shadow mask by the scanning of the laser beam with a predetermined position as a scanning point, so that the irradiated portions are heated and burned, and removed, to form a black matrix composed of the light absorbing material of such portions that are not irradiated with the laser beam.

DESCRIPTION OF PREFERRED EMBODIMENTS

The invention will be described below in further detail by way of an embodiment.

Figure 1:
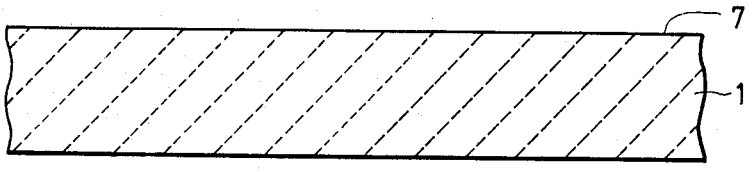
FIGS. 1, 2, 3 and 4 are section views of major portions of a panel of a color picture tube, and illustrate steps of a method of producing a phosphor screen of a color picture tube according to an embodiment of the present invention.
Figure 2:
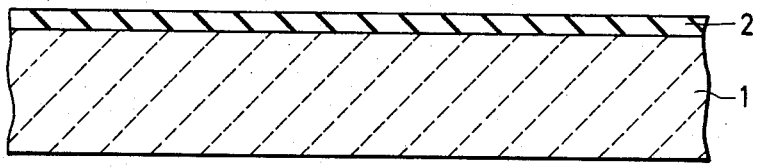

FIGS. 1 to 4 are section views of major portions of a panel of a picture tube, and illustrate the method of producing a phosphor screen of a color picture tube according to an embodiment of the present invention. First, as shown in FIG. 1, the inner surface 7 of a panel 1 (of, e.g., transparent glass) of, for example, a 14-inch type color picture tube is washed and is dried. Then, as shown in FIG. 2, a suspension containing about 4% by weight of graphite is uniformly applied by the spinning method onto the inner surface of panel 1 to a thickness of about 0.5 μm, and is dried to form a light absorbing black material film 2. As the suspension containing graphite there can be employed, e.g., HITASOL G72B or G107(Trademark of Hitachi Funmatsuyakin Kabushiki Kaisha, in Japan) diluted twice with water and to which small amounts of ammonia water is incorporated to adjust the pH. As other suspensions usable in the present invention see the suspensions discussed in U.S. Pat. No. 3,558,310, the contents of which is incorporated by reference. The light absorbing material film can have a thickness, for example, of 0.2 μm to 1.0 μm.

Figure 3:
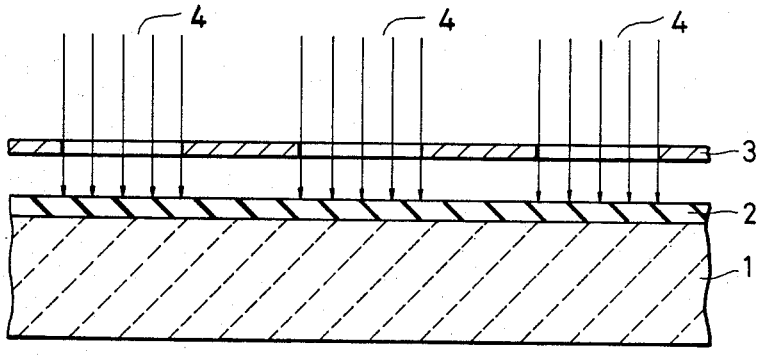
Figure 4:
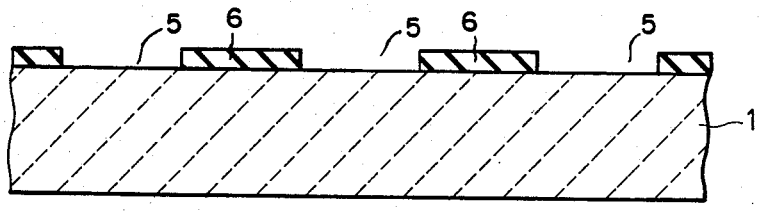

Next, as shown in FIG. 3, a shadow mask 3 with mask apertures measuring about 90 μm in diameter and about 0.21 mm in pitch is disposed to be opposed to the surface of the light absorbing material film 2. Such shadow mask can be the same as ones conventionally used; in this regard, see U.S. Pat. No. 3,558,310. The scanning point of, e.g., a Gd:YAG laser source is disposed, over the shadow mask 3, at a position where a light source for the green emitting point is to be located during the process of the phosphor film pattern formation. Via a correction lens (widely used for effecting exposure when a phosphor film pattern is to be formed, in order to bring the electron beam trajectory into agreement with the optical path for exposure) which is not shown in FIG. 3, the whole inner surface of panel 1 is scanned, such that the whole inner surface of panel 1 is irradiated with a laser beam 4 in the air. Portions of the light absorbing material film 2 irradiated with the beam are heated and burned, thereby to form black matrix holes 5 measuring about 75 μm in diameter as shown in FIG. 4. In this case, output of the laser beam 4 is about 200 watts, diameter of beam is about 85 μm, scanning speed is about 70 meters/sec., and fluctuation in the output is ±1%. Generally, the energy density of the laser beam should preferably be at least 400 $W/cm^2$.sec., and the laser irradiation time for unit area should be at most 10 msec. The output power, the diameter and the scanning speed of the laser beam should be designed to fulfill the energy density and irradiation time (for unit area) of the laser beam as indicated above. In the present embodiment, the energy density of the laser beam was 503.5 $W/cm^2$.sec., and the irradiation time per unit are was 143 μsec. Scanning is further repeated under the same conditions as described above, by bringing the scanning point of the laser source to the position of a light source of the blue emitting point and then to the position of a light source of the red emitting point, thereby to form black matrix holes 5 at positions where phosphors of three colors are to be arranged. In this case, there are formed light absorbing films 6 composed of the light absorbing material film 2 of such remaining portions that were not irradiated with the laser beam 4. Thereafter, phosphor films composed of phosphor particles of green, blue and red colors are formed by the widely known slurry method or dusting method in the black matrix holes 5 on the inner surface of the panel 1 on which the black matrix pattern consisting of the light absorbing films 6 is formed. As is known, furthermore, a film of acrylic resin and a metal backing film are formed thereby to complete the phosphor screen of the color picture tube.

The color picture tube formed according to the method of the embodiment of the present invention was compared with a color picture tube which had the same construction as that of the embodiment of the invention but in which the black matrix pattern was formed according to the conventional photoresist method, with regard to defects on the phosphor screen and white uniformity, of which the level is nearly determined by the degree of conformity between the positions of black matrix holes corresponding to phosphors of three colors and the positions of phosphors of each of the colors. The results were tabulated below:

TABLE

| | Number of Defects on the Phosphor Screen | White Uniformity |
|---|---|---|
| Embodiment of the Invention | 3 | 7 |
| Conventional Method | 8 | 8 |

According to the method of the present invention, as will be obvious from the above Table, since the steps for forming the black matrix are greatly simplified, and the number of steps is reduced, there is obtained a color picture tube having fewer defects on the phosphor screen, increased white uniformity (which is to relatively evaluate the quality of colors, and the level thereof increases with the decrease in the numerical values), and enhanced quality and reliability.

The above embodiment has dealt with the case where the Gd:YAG laser beam was used to heat and burn the light absorbing material film. The invention, however, is in no way limited to the above-mentioned case only, but can be put into practice in the same manner even by using a carbon dioxide laser beam or any other laser beam (e.g., such as an exima laser beam).

Further, the above embodiment has dealt with the case where the black matrix pattern was so formed as to constitute a screen of dot pattern. The invention, however, can also be put into practice in the same manner even when a striped black matrix pattern is to be formed. In this case, the laser beam is scanned in the lengthwise direction of mask slots of the shadow mask in a step of the production method of the present invention, to obtain a black matrix having highly accurate stripe widths.

In the above-mentioned embodiment, furthermore, the invention was adapted to a 14-inch type color picture tube. The invention, however, can be adapted to any other picture tube having a patterned phosphor screen, as a matter of course.

According to the method of producing a phosphor screen of color picture tube of the present invention mentioned in the foregoing, the black matrix is formed utilizing irradiation with a laser beam via a shadow mask, to thereby simplify the steps for forming the black matrix and to reduce the number of steps. Therefore, defects developed in the individual steps build up in small amounts, and it is made possible to obtain a color picture tube of high quality while maintaining improved production yields.

While we have shown and described several embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

What is claimed is:

1. In a method of producing a phosphor screen of a color picture tube having a black matrix formed on the inner surface of a panel, the improvement wherein the method comprises the steps of applying a light absorbing material onto the inner surface of said panel to form a film thereof on the inner surface of said panel; providing a shadow mask; and scanning and irradiating said film of said light absorbing material with a laser beam through said shadow mask, with a predetermined position as a scanning point of the laser beam, so that portions of said film of said light absorbing material irradiated with the laser beam are heated and burned, thereby to form the black matrix.

2. A method of producing a phosphor screen of a color picture tube according to claim 1, wherein said laser beam is a YAG laser beam.

3. A method of producing a phosphor screen of a color picture tube according to claim 1, wherein said black matrix has holes where the light absorbing material has been heated and burned, and further comprising a step of forming phosphor films composed of phosphor particles of desired colors in the holes of said black matrix, after said black matrix has been formed.

4. A method of producing a phosphor screen of color picture tube according to claim 1, wherein a correction lens is provided between said scanning point and said shadow mask.

5. A method of producing a phosphor screen of color picture tube according to claim 3, wherein said predetermined position exists at a position where a light source for exposure is to be positioned when a film pattern for a phosphor material is to be formed.

6. A method of producing a phosphor screen of a color picture tube according to claim 5, wherein the step of scanning and irradiating is repeated from a different predetermined position, said different predetermined position being a position where a light source for exposure is to be positioned when a film pattern for a different phosphor material is to be formed.

7. A method of producing a phosphor screen of a color picture tube according to claim 1, wherein the phosphor screen includes phosphor particles of differently colored phosphor materials, wherein each of the differently colored phosphor materials has a different position where a light source for exposure is to be positioned when a film pattern for such differently colored phosphor material is to be formed, and wherein the step of scanning and irradiating is performed at each of the different positions where said light source for exposure is to be positioned.

8. A method of producing a phosphor screen of a color picture tube according to claim 7, wherein the phosphor particles of differently colored phosphor materials are particles of red phosphor materials, particles of green phosphor materials, and particles of blue phosphor materials; and wherein the steps of scanning and irradiating is performed at the positions, respectively, where a light source for exposure is to be positioned when a film pattern for the red phosphor materials, the green phosphor materials and the blue phosphor materials is to be formed.

9. A method of producing a black matrix of a color picture tube, the black matrix being formed on the inner surface of a panel, comprising the steps of applying a light absorbing material onto the inner surface of said panel, to form a film thereof on the inner surface of said panel; providing a shadow mask; and scanning and irradiating said film of said light absorbing material with a laser beam through said shadow mask, with a predetermined position as a scanning point of the laser beam, so that portions of said film of said light absorbing material irradiated with the laser beam are heated and burned, thereby to form the black matrix.

10. A method of producing a black matrix of a color picture tube according to claim 7, wherein the scanning and irradiating is repeated, from a different predetermined position as a scanning point of the laser beam.

11. A method of producing a black matrix of a color picture tube according to claim 9, wherein said light absorbing material includes graphite.

* * * * *